United States Patent [19]

Singer

[11] 4,329,896

[45] May 18, 1982

[54] SLITTER FOR SEVERING LAMINATED OBJECTS

[76] Inventor: Karl Singer, 2282 Thorntree, Palatine, Ill. 60067

[21] Appl. No.: 138,534

[22] Filed: Apr. 9, 1980

[51] Int. Cl.[3] ..... B26D 5/22

[52] U.S. Cl. ..... 83/210; 83/371; 83/578; 83/614; 83/697

[58] Field of Search ..... 83/176, 208, 209, 210, 83/578, 614, 422, 436, 651, 697, 371

[56] References Cited

U.S. PATENT DOCUMENTS

| | | | |
|---|---|---|---|
| 1,920,591 | 8/1933 | Pesci | 83/578 X |
| 1,937,576 | 12/1933 | Kast et al. | 83/156 X |
| 2,365,605 | 12/1944 | Sutter | 83/449 X |
| 2,792,890 | 5/1957 | Dyken | 83/614 X |
| 3,192,811 | 7/1965 | Simmons | 83/210 X |
| 3,203,291 | 8/1965 | Elsas | 83/210 X |
| 3,273,435 | 9/1966 | Hubner et al. | 83/371 X |
| 3,620,114 | 11/1971 | Chudyk | 83/208 X |
| 3,641,854 | 2/1972 | Keesling | 83/578 X |
| 3,782,664 | 1/1974 | Alberto | 83/371 X |

*Primary Examiner*—James M. Meister

*Attorney, Agent, or Firm*—Robert E. Wagner; Leo J. Aubel

[57] ABSTRACT

A slitting machine for separating the overlapped portion of a web of continuously laminated articles is provided by the present invention wherein a cutting means having two oppositely-facing cutting blades is mounted to a carriage and selectively reciprocated back and forth across the web as controlled by electrical circuitry to slit the laminate material between successive articles.

2 Claims, 4 Drawing Figures

MOTOR CONTROLLER
AC TRIAC
D.C. RELAY
AC TRIAC 1
AC TRIAC 2
LATCH 1
LATCH 2
LATCH 3
ONE SHOT 4
ONE SHOT 5
ONE SHOT (DELAY) 1
MOTION DETECT.
ONE SHOT 3
F/F (SIG COND)
F/F ALTER.
AMP.
ONE SHOT DELAY 2
DUAL AMP. 1
DUAL AMP. 2

SLITTER FOR SEVERING LAMINATED OBJECTS

DESCRIPTION

1. Technical Field

The present invention relates generally to laminated sheet trimmers and, more specifically, to a trimming machine having a double-edged blade operable to separate two overlapping sheets of laminated material by slitting the laminate between the sheets.

2. Background Prior Art

The use of laminating machines to apply laminate material to such items as menus, placemats and the like for their protection and increased durability has been common practice for many years. In certain prior art laminating machines, items or articles to be laminated are fed at spaced intervals between an upper and lower web of laminate material which engage the top and bottom of the work to be laminated. Heat is then applied to adhere the laminate to both surfaces of the article.

Other types of laminating machines utilize a single web of laminate material for application to one surface of an article. In such machines, the borders or margins of adjacent or successive articles are overlapped forming a continuous web of laminated articles which avoids spillage of the laminate material in between the articles. Such spillage could cause jamming of the laminating machine and other operational difficulties.

One method of separating successive laminated articles in a continuous web involves the use of a slitting machine in which operators manually separate the overlapped portion between adjacent articles. A knife blade is used to slit the laminate material between the overlapped borders of successive articles in the web. It can be appreciated that the speed of such manually-operated cutters is dependent on the individual skill and experience of the operator, and involves considerable labor costs.

A second type of manually-operated slitter may be used to separate adjacent articles in a web, wherein a guillotine-type blade cuts the ends of adjacent articles to form a border. Although such cutters may be somewhat easier to operate than those described above which slit adjacent articles apart, it has been found that guillotine-blade cutters are inefficient since at least two separate cuts must be made to assure that both adjacent articles are properly trimmed. One cut is needed to form a margin or border of a desired size on one article, and a second cut is made on the other article to trim away the overlapped portion of the border from the first article.

SUMMARY OF THE INVENTION

The subject invention eliminates the inefficiencies and reduces the labor costs of operating prior art cutters, by providing a fully automatic slitting machine having a double-edged cutting blade which cuts or slits overlapped articles apart in an efficient and rapid operation. The cutting means herein is mounted on a carriage for movement back and forth along the width of the web of laminated articles, which movement is controlled and synchronized with the advance of the web by electric circuitry. The blade of the cutting means is double edged for slitting the laminate in between the overlapped portion of adjacent articles while moving in either direction along the web.

BRIEF DESCRIPTION OF SEVERAL VIEWS OF DRAWINGS

DETAILED DESCRIPTION OF THE INVENTION

Figure 1:
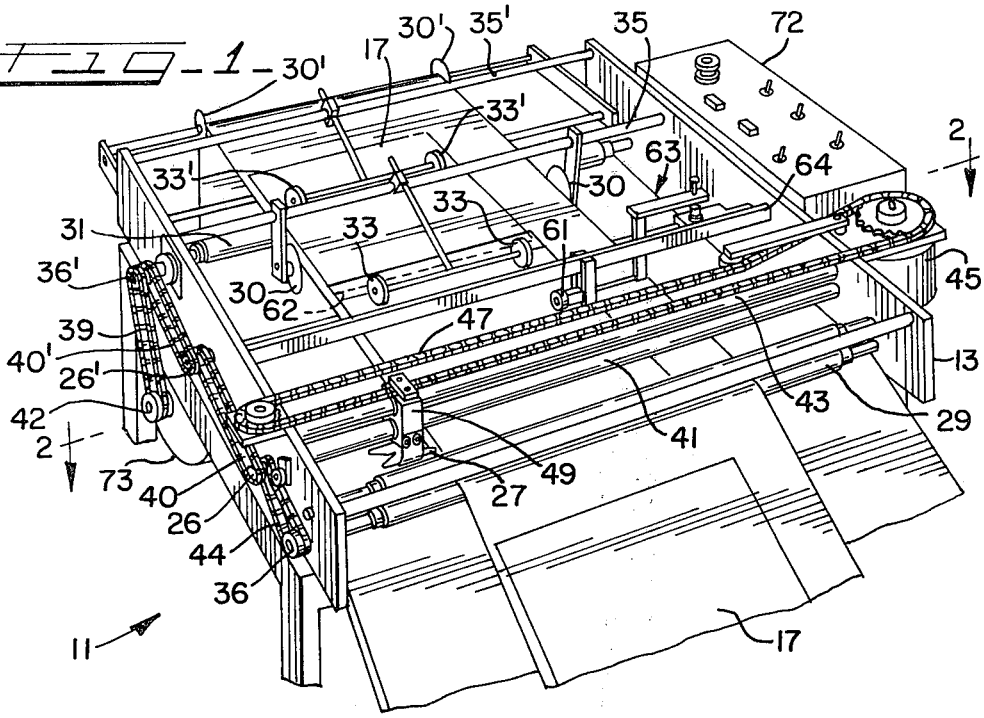
FIG. 1 is a partial perspective view of the trimming machine of the present invention showing the gear train for driving the web along the machine, and the cutter carriage drive means.

Referring now to the drawings, and in particular to FIG. 1, the slitter of the present invention is labeled with the reference numeral 11. A web of laminated articles 17 may be mounted for rotational movement on an outwardly extending arm (not shown) attached rearwardly on frame 13 of slitter 11. As an alternative, a continuous web feeder machine (not shown) may be electrically or mechanically synchronized with the slitter 11 to provide a continuous supply of laminated articles 17 to be slit. The web feeder machine feeds additional laminated sheets or articles 17 from a web to the slitter 11 in response to a tightening of the web as successive articles 17 advance through slitter 11.

The upper portion of slitter 11 includes a series of cooperating rollers driven by corresponding sprockets and link chains along which the web of laminated articles 17 is fed to a position adjacent cutter 27. A front drive rod 29 and a rear drive rod 31 engage the bottom of the web of laminated articles 17 for movement along frame 13. Drive rods 29 and 31 are driven by sprockets 36 and 36', which are interconnected for unitary movement by a pair of idler sprockets 26 and 26'. A link drive chain 39, extending between the output sprocket 42 of variable speed motor 73 and sprocket 36', drives sprocket 36'. Idler sprocket 26' is connected by idler chain 40' to sprocket 36' and by idler chain 40 to idler sprocket 26. Drive sprocket 36, connected by link chain 44 to idler sprocket 26, is thus rotated in unison with drive sprocket 36'.

Two features of the present invention provide for positive movement of the web of laminated articles 17 along frame 13. Hold-down rollers 33 and 33' are positioned along frame 13 and engage the web of laminated articles 17 to assure positive movement of the web therealong with a minimum of slippage. Hold-down rollers 33 and 33' are mounted to shafts 35 and 35', respectively, which are fixed to frame 13 on either end, and may be adjusted to vary the force exerted on articles 17. Slitter 11 also includes a pair of front and rear guide discs 30 and 30' which are adjustably mounted to shafts 35 and 35', respectively, along either edge of the web. Guide discs 30 and 30' assure that the web remains in proper alignment relative to the cutter 27 to permit a straight slit along the edges of each article 17 as discussed in more detail below.

As mentioned above, prior art devices for separating articles laminated on a machine in which the borders of adjacent articles are overlapped, generally utilize guillotine-type cutters for trimming the ends of adjacent articles, or slitters which slit adjacent articles apart. Both of these types of cutters are manually operated, and are only as efficient as the skill and experience of the operators.

Figure 4:
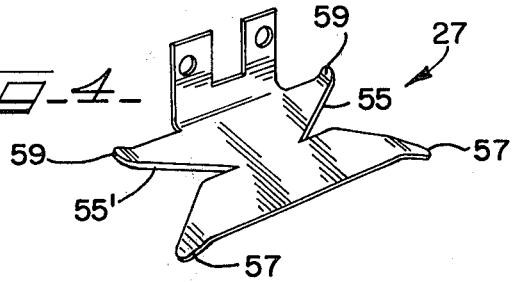
FIG. 4 is a perspective view of the double-edged cutter of the present invention.
Figure 2:
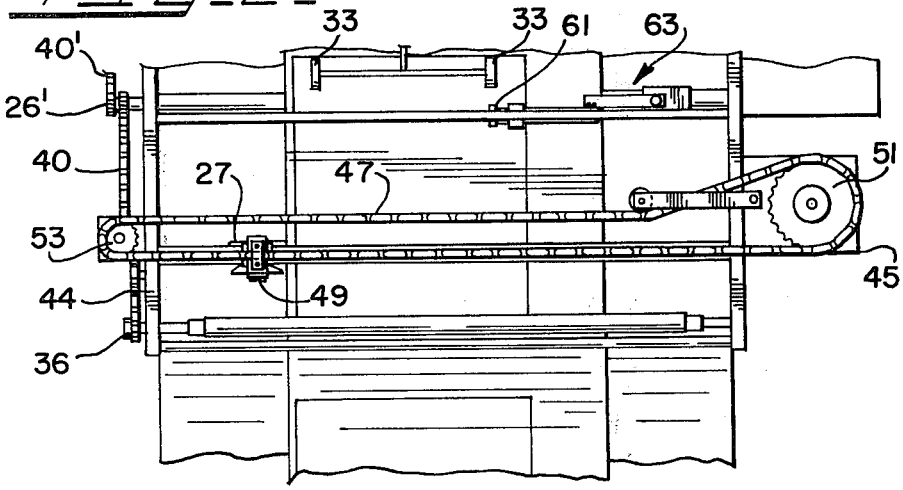
FIG. 2 is a partial plan view of the cutter carriage drive means and the sensor roller which activates the electric control circuitry.

The present invention improves on the efficiency of existing manual cutters by providing a unique, fully automatic cutter mechanism operable to accurately slit the laminate between two overlapped articles which separates such articles without the need for individual trimming. This is accomplished by a cutter 27 attached to a cutter carriage 49 which is mounted on guide bars 41 and 43 for reciprocation from side to side across frame 13. A motor 45, operated by circuitry shown in FIG. 3 and described in detail below, drives a drive chain 47 which attaches at each end to carriage 49 to move the cutter 27 across the web of laminated articles 17. Chain 47 extends between a sprocket 51 mounted on motor 45 and an idler sprocket 53 rotatably mounted at the opposite side of frame 13 (see FIG. 2). As shown in detail in FIG. 4, cutter 27 has two oppositely-facing cutting blades 55 and 55' to cut the web of laminated articles 17 as it moves in both directions across frame 13 with carriage 49. Cutting blades 55 and 55' are disposed between a downwardly-facing guide edge 57 and an upwardly-facing guide edge 59. Guide edges 57 and 59 cooperate to urge one of the adjacent overlapping articles 17 upwardly and the other downwardly to assure accurate slitting of the laminate material between such articles 17 by either cutting blade 55 or 55'.

Figure 3:
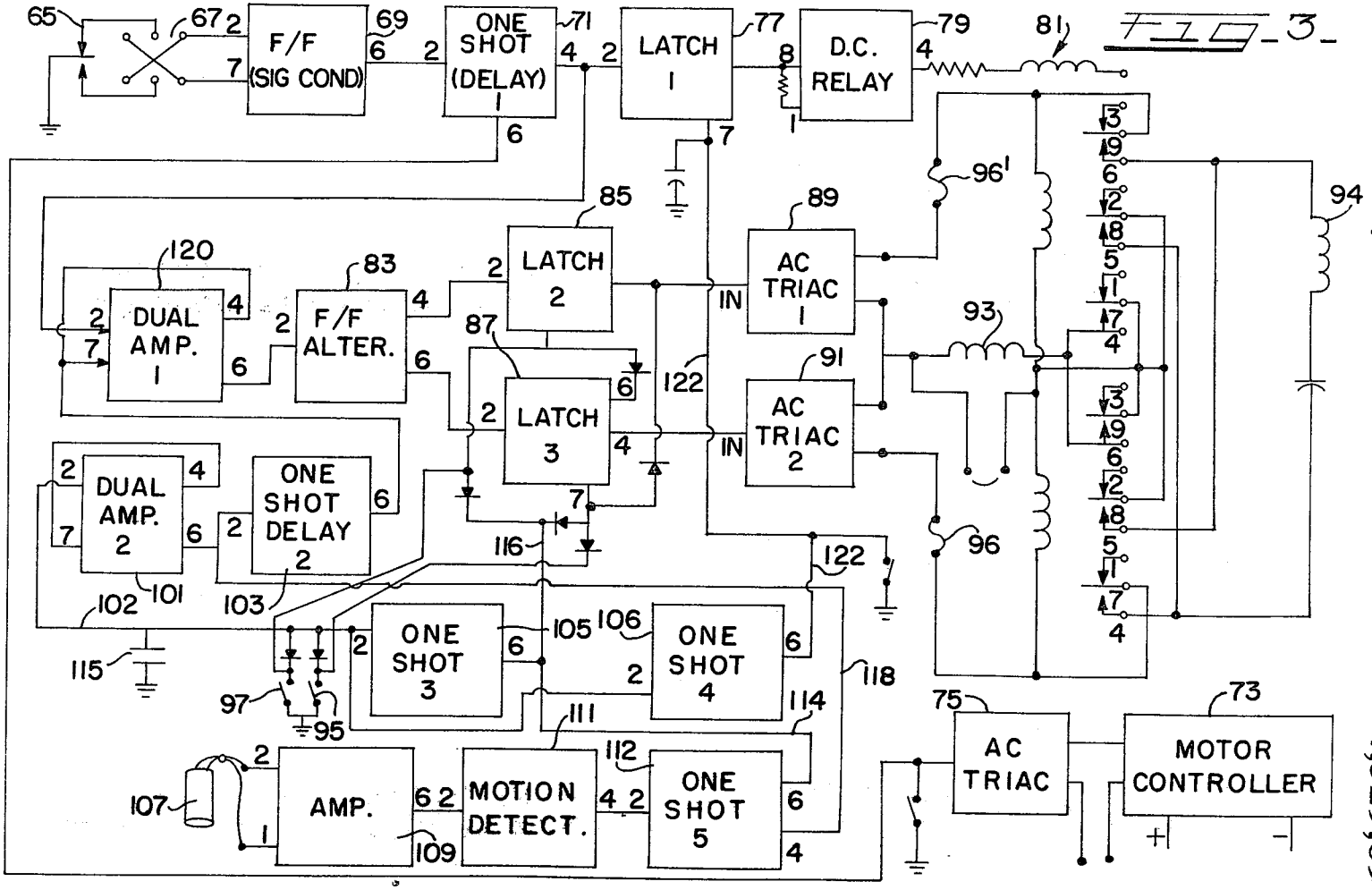
FIG. 3 is a schematic view of the electric control circuitry herein.

Referring now to FIG. 3, a schematic diagram of electrical circuitry is shown which controls the operation of motor 45 and the movement of carriage 49 and cutter 27. A sensor roller 61 is adjustably mounted on roller bracket 63 which is fixed to a bar 64 attached to frame 13. Sensor roller 61 lightly contacts the surface of the web of laminated articles 17 as it moves along frame 13. Sensor roller 61 is connected to a lap switch 65 which reads or senses a small height variation as the overlapped portion 62 of adjacent laminated articles 17 moves beneath (see FIG. 1). A double-pull/double-throw switch 67 determines whether the lap switch 65 has been activated in response to an upward movement of sensor roller 61 along the overlapped portion 62 of laminated articles 17, or a downward movement from such overlapped portion 62. In response to an upward movement of sensor roller 61, double-pull/double-throw switch 67 sends a signal to a first flip flop, which is a signal conditioning flip flop. First flip flop 69 sends a signal to a first one-shot relay 71 having an adjustable time delay on the control panel 72 which controls the length of movement of the web of laminated articles 17 from the time lap switch 65 is activated to the time an overlapped portion 62 of adjacent laminated articles 17 is in alignment with cutter 27.

A variable speed motor 73 drives front and rear rods 29 and 31 to move the web along frame 13. As the first one-shot relay 71 receives a signal, it immediately sends a signal to a third AC triac 75 to maintain rotation of the front and rear drive rods 29 and 31. Once the first one-shot relay 71 (which is a delay relay) times out, a signal is sent to a first latch 77 which, in turn, activates a DC relay 79 to apply a brake 81 to motor 73. Brake 81 stops the web in a position wherein the lapped portion 62 of adjacent laminated articles 17 is directly aligned with cutting edges 55 or 55' depending on which side of frame 13 the cutter 27 has stopped. The third triac 75 is activated during the timing period of first one-shot relay 71 to assure continued movement of the web of laminated articles 17 to cutter 27. Otherwise, the web would stop short of cutter 27 as brake 81 is applied and the slitting action would not be applied to an overlapped portion 62.

The remainder of the electrical circuitry in FIG. 3 selectively activates motor 45 for moving the carriage 49 across the web in timed relation with the braking of the web by brake 81. At the same time a signal is sent from first one-shot relay 71 to first latch 77, a signal is sent to first flip flop alternator 83. Depending on which side of the frame 13 cutter 27 is positioned after the previous cut of the web, flip flop alternator 83 will send a signal to either a second latch 85 or a third latch 87. Once either second latch 85 or a third latch 87 is activated, a signal is sent to a first AC triac 89 or second AC triac 91, respectively.

The gear motor 45 which reciprocates cutter 27 is a capacitator starter gear motor. The run winding 93 is always energized by one of two relays (not shown). First and second AC triacs 89 and 91, when activated by a signal from second latch 85 or third latch 87, respectively, send a signal to the start winding 94 to turn the motor 45 on. Three-quarter amp fuses 96 and 96' are provided in the event motor 45 tries to run in both directions at the same time.

Motor 45 operates to move carriage 49 to the opposite side of frame 13 until it engages either the right limit switch 95 or the left limit switch 97, depending on the original position of carriage 49. The limit switches 95 and 97, when activated, reset the second latch 85 or third latch 87 which, in turn, switch off the signal from the first triac 89 or second triac 91, respectively. When the power from first or second triacs 89 or 91 to motor 45 is shut off, a built-in electrical brake in motor 45 is activated to stop it.

When carriage 49 contacts either the left limit switch 97 or right limit switch 95, second latch 85 or third latch 87, respectively, are reset. Once reset, the output of latches 85 and 87 goes to a second reset 101 or a third reset 103, respectively, which send a signal to reset the first latch 77. As first latch 77 is reset, brake 81 releases drive shafts 29 and 31, allowing the web of laminated articles 17 to continue to advance along frame 13 in preparation for another cut.

In the event slitter 11 jams due to a misfeed, or any other reason, blade 27 will stop because the clutch (not shown) mounted on motor 45 will slip. A proximity sensor 107 of any suitable well-known type is positioned to sense or read the teeth on the sprocket on motor 45. The sensor 107 will develop an electrical signal when the teeth are stopped, which signal is amplified by amplifier 109 and coupled to a motion detector 111. The output of motion detector 111 activates a monostable or one-shot multivibrator 112 to provide a pulse via lead 114 and lead 116 to reset both latches 85 and 87, thereby stopping motor 45. A pulse from one-shot 112 coupled out through lead 118, after a present delay provided by one-shot multivibrator 103, will be amplified in amplifier 120 and coupled to flip flop or bi-stable multivibrator 83. Flip flop 83 will thus change states and provide an input to latches 85 and 87 to energize the motor 25 in the relatively opposite direction, to thereby back the blade out of the jammed position, until one of the limit switches 95 or 97 is contacted.

When the contact limit switch, either 95 or 97, closes, one-shot multivibrator 106 provides a pulse via lead 122 to deactivate or unlatch latch 77, thereby allowing the rollers to run, moving the web to the next cutting position.

Each time the sprocket on motor 45 stops, a pulse is developed by multivibrator 112. If either limit switch 95 or 97 is closed, thereby indicating that the blade made a successful cut, the pulse from the multivibrator 112 is inhibited from triggering multivibrator 103. Note that the input to amplifier 101 from one-shot 105 is coupled through lead 102 to amplifier 101 and that switches 95 and 97 are connected from lead 102 to ground. When either switch 95 or 97 is closed, the output of amplifier 101 is at ground reference, or low, and thus the input of multivibrator 103 is low.

A capacitor 115 is connected from lead 102 to ground to prevent any spurious signals, due to contact bounce of the limit switches 95 and 97, from activating latches 85 and 87.

A reset push button 99 allows the operator to set up the machine while keeping the cutter switch off. When the web stops, the operator can visually check to see if the lap of the web has been stopped in proper position to be cut. If not, the delay control can be adjusted, the reset push buttom 99 pressed again, and the web moved to the next position for another visual check. If the web has now been stopped in the proper position, the cutter switch can be turned on and the blade actuated to cut the sheet. Accordingly, the addition of the foregoing circuitry makes the cutter completely automatic once the delay time is adjusted.

While the invention has been described with reference to a preferred embodiment, it will be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

I claim:

1. In a slitting machine for slitting laminate material between adjacent articles in a continuous web of said articles, said articles having borders, the borders of adjacent articles being overlapped and encased by said laminate material to form said continuous web, the improvement comprising cutting means, said cutting means having oppositely-facing cutting blades for slitting said laminate material between the overlapped portion of adjacent articles, said cutting means being formed with a downwardly-extending guide edge on one side of each of said cutting blades, and an upwardly-extending guide edge on the other side of each of said cutting blades, said guide edges cooperating to urge the borders of said adjacent articles apart as said cutting blades slit said laminate material between said adjacent articles.

2. A slitting machine for slitting laminate material between adjacent articles in a continuous web of said articles, said articles having borders, the borders of adjacent articles being overlapped and encased by said laminate material to form said continuous web, said slitting machine comprising:

web drive means for advancing said web of laminated articles through said slitting machine;

cutting means including a cutter having oppositely-facing cutting blades for slitting said web;

cutting means drive means for moving said cutting blades of said cutting means back and forth across said web of laminated articles, said cutting blades being operable to slit said laminate material between said overlapped portion of adjacent articles in both directions across said web;

electrical control circuitry, said control circuitry including means to selectively activate said web drive means and said cutting means drive means for synchronized operation, said control circuitry activating said web drive means to advance said web of laminated articles in alignment with one of said cutting blades, and to stop said web whereupon said control circuitry activates said cutting means drive means for moving said cutting blades across said web to slit said laminate material between said overlapped portion of adjacent articles; and said electrical control circuitry including roller sensor means, said roller sensor means contacting said web of laminated articles as said web advances along said slitting machine, said roller sensor means moving upwardly relative to said web as said roller sensor means contacts said overlapped portion of adjacent articles, said electrical control circuitry being activated in response to said upward movement of said roller sensor means for controlling said web drive means and said cutting means drive means.

* * * * *